United States Patent [19]

Bries

[11] Patent Number: 4,624,889

[45] Date of Patent: Nov. 25, 1986

[54] LAUNDERABLE TEXTILE SIZING HAVING STAIN RESISTANCE AND SOIL RELEASE

[75] Inventor: James L. Bries, Cottage Grove, Minn.

[73] Assignee: Minnesota Mining and Manufacturing Company, St. Paul, Minn.

[21] Appl. No.: 642,133

[22] Filed: Aug. 17, 1984

[51] Int. Cl.[4] ..... D06M 15/09; D06M 15/11; D06M 15/256

[52] U.S. Cl. ..... 428/264; 252/8.6; 252/8.75; 252/8.9; 427/393.4; 427/421; 428/265; 428/272; 428/274; 428/290; 428/395; 428/422; 524/37; 524/44; 524/45; 524/46; 524/47; 524/55; 524/544

[58] Field of Search ..... 252/8.6, 8.75, 8.9; 427/393.4; 428/264, 265, 272, 274, 290

[56] References Cited

U.S. PATENT DOCUMENTS 3,574,791 4/1971 Sherman et al. .
3,575,899 4/1971 Pryor et al. .
3,728,151 4/1973 Sherman et al. .
3,813,359 5/1974 Tweedy et al. .

*Primary Examiner*—James C. Cannon
*Attorney, Agent, or Firm*—Donald M. Sell; James A. Smith; Richard Francis

[57] ABSTRACT

An aqueous fabric treating composition or sizing has been developed for application on laundered fabrics which provides excellent sizing together with oil and water repellency and improved soil release during laundering. The composition comprises a water soluble sizing, hybrid copolymer containing water-solvatable polar groups and fluoroaliphatic groups, and water. A method of treating fabrics and treated fabrics are also disclosed.

13 Claims, No Drawings

LAUNDERABLE TEXTILE SIZING HAVING STAIN RESISTANCE AND SOIL RELEASE

DESCRIPTION

1. Technical Field

The present invention relates to fabric treating compositions. More particularly, the present invention relates to a fabric sizing which imparts oil and water repellency to fabric treated therewith and improved soil release during laundering of the sized fabric.

2. Background Art

Fabric sizing agents such as starch are usually applied to launderable fabrics such as those made of cotton or cotton and polyester to add body and stiffness and improve the ironability. Such sizing agents have been used for a great number of years.

Since the development of soil and stain resistant treating materials, for example, certain fluorochemical compounds, sizing compositions including stain resistant treating substances have also become popular. For example, U.S. Pat. No. 3,813,359 (Hunter et al) discloses a textile sizing including a fluoro polymer emulsion preferably of the perfluoro acrylate and alpha-substituted acrylate type. U.S. Pat. No. 3,809,663 (Elkind et al) discloses a textile sizing composition which includes a fluoropolymer latex. U.S. Pat. No. 3,575,899 (Pryor et al) discloses a launderably removable soil and stain resistant fabric treatment including a sizing material and a fluorochemical compound with both oleophobic and hydrophobic properties but which retains these properties during laundering.

While many references disclose fabric treatments which may impart soil and stain resistance, for the most part, none of these provide any hint as to whether or not such fabric treatments could be incorporated into fabric sizing compositions to provide any improved properties such as stain resistance or improved stain release. In fact, some of the stain resistant treatments may be adversely affected in the presence of certain of the ingredients contained in sizing compositions and the combination could produce less than a desirable result.

U.S. Pat. No. 3,728,151 (Sherman et al) and U.S. Pat. No. 3,574,791 (Sherman et al), assigned to the assignee of the present application, disclose fabric treatments based upon certain hybrid copolymers containing water solvatable polar groups and fluoroaliphatic groups which have soil and stain resistant properties yet afford ease of launderability because the copolymers are oleophobic and hydrophobic under atmospheric conditions yet hydrophilic during laundering. This permits improved soil and stain release. These patents fail to indicate whether or not such fabric treatments will be useful with sizing agents.

DISCLOSURE OF THE INVENTION

The present invention provides a sizing fabric treatment which provides excellent sizing of launderable fabrics. The sized fabrics have very desirable oil and water repellency and improved stain release during laundering. The treating composition of the present invention comprises a conventional water soluble sizing agent, a hybrid copolymer containing water-solvatable polar groups and fluoroaliphatic groups, and water. The sizing agent provides its usual function of stiffening and improving the ironability of the fabric. The hybrid copolymer imparts oleophobicity and hydrophobicity to the surface of the fabric being treated yet, during laundering, the hybrid copolymer has the ability to convert to hydrophilicity thereby rendering the surface of the fabric more amenable to cleaning and soil release.

More specifically, the present invention provides a fabric treating composition for frequently laundered fabrics capable of rendering the surface of fabric treated therewith oleophobic and hydrophobic under atmospheric conditions. The composition comprises:

(a) water-soluble fabric sizing agent;

(b) reversibly autoadaptable segmented hybrid copolymer having a maximum glass temperature below about 130° C. comprising a balance of the following:

(i) one or more hydrophilic segments containing an average of more than two water-solvatable polar groups and substantially free from fluorinated aliphatic pendent groups of at least 3 carbon atoms terminated by trifluoromethyl groups, and (ii) one or more fluorinated segments substantially free from water-solvatable polar groups and containing an average of at least two fluoroaliphatic pendent groups terminated by trifluoromethyl groups, which contain at least 3 and not more than 20 fully fluorinated carbon atoms and provide in the copolymer at least 1% bound fluorine, the intraconnecting structure of said fluorinated segments being substantially free of fluorine and the fluorinated segments being non-glassy and amorphous at a temperature not higher than 130° C., said copolymer being internally oleophobic and substantially water insoluble after application to said fabric; and (c) water wherein the weight ratio of hybrid copolymer to sizing agent is greater than about 1 part hybrid copolymer to 50 parts sizing agent and the concentration of sizing agent in said composition is at least about 0.05% by weight.

The hybrid copolymers which are useful in the practice of the present invention are described in aforementioned U.S. Pat. Nos. 3,574,791 and 3,728,151, the disclosures of which are incorporated herein by reference and made a part hereof for such description.

As mentioned in the two references cited above, in discussing oleophobicity, hydrophobicity, oleophilicity and hydrophilicity, one must understand that the terms are not absolute in meaning. Thus several fabrics may possess oleophobicity in different degrees. Treated fabrics may be compared with respect to all of these properties and have certain properties to useful extents, although essentially lacking other properties. The release of oily stains from a treated fabric on laundering requires a considerable degree of hydrophilicity in water. A net or resultant oleophobicity under laundering conditions is also needed. It is not essential that the treated fabric also be strongly or durably oleophobic and/or hydrophobic in air for the treatment to be useful; although it must be more so than untreated fabric.

The hybrid copolymers are coatable on the fabric to provide a surface having oleophobic and hydrophobic characteristics in an air atmosphere and possessing oleophobic and hydrophilic characteristics in an aqueous medium. When copolymers are used to treat a fabric, the fabric is laundered in water, it becomes hydrophilic and the removal of oily stains from the fabric is made possible.

The change from oleophobicity and hydrophobicity in air to net oleophobicity and hydrophilicity in water is termed autoadaptibility.

As recognized in the aforementioned two references, to possess characteristics of autoadaptibility as here contemplated, two different types of structure are present in the hybrid copolymer, namely fluorinated segments and hydrophilic segments which have interconnecting structure between segments.

A fluorinated segment is a portion of the polymer which includes a multiplicity of highly fluorinated aliphatic radicals and the intraconnecting structure therebetween but is substantially free from hydrophilic groups. Correspondingly a hydrophilic segment is a portion of the polymer which includes a multiplicity of polar groups and their intraconnecting structure substantially free from fluorinated aliphatic groups.

It will be evident that a polymer may include portions of its interconnecting structure which are neither fluorinated nor hydrophilic segments. Furthermore, it will be apparent that the intraconnecting structure within the segments may not be entirely free from either fluorinated aliphatic or polar groups. It is only necessary to recognize that polymers have fluorinated segments and hydrophilic segments may be formed under a wide variety of conditions and processes and hence segments may and do occur in a large group of copolymers. It is preferred that the structure be of the types known as block or graft copolymers. It is generally preferred that the interconnecting structure constitute not more than about 50% of the copolymer by weight and still more preferred that it not constitute more than 25% thereof.

It is further preferred that each fluorinated segment contain two or more pendent groups (fluorinated occurrence) terminating in highly fluorinated aliphatic groups. In the copolymer as a whole it is preferred that every pendent group of this fluorinated aliphatic type be associated with at least one other such group to form a segment. If some pendent groups of the fluorinated aliphatic type are not associated in segments, i.e., are solitary fluorinated occurrences it is preferred that the number thereof be at least equalled by the number of segments containing three or more pendent groups so that the average number of pendent fluorinated aliphatic groups per fluorinated occurrence is two or more. Thus, there should be at least twice as many pendent groups as the number of solitary groups and segments combined.

Likewise for the polar groups it is preferred that all be associated in groups of two or more, i.e., as segments. When any are solitary, hydrophilic occurrence, it is preferred that the number thereof be more than equalled by the number of segments containing three or more polar groups. The average number based on all occurrences will thus be more than two.

It is generally preferred that the number of polar groups exceed the number of fluoroaliphatic groups. However, in the case of acidic polar groups, particularly sulfonic acid groups, it is preferred that they be present in lesser number than the number of fluoroaliphatic groups.

Although it is indicated above that the polymer should contain a fluorinated segment of at least an average of two fluorinated aliphatic groups, it is contemplated that in certain polymer structures all the fluorinated occurrences may contain only one fluorinated aliphatic group but the polymer in such instance will contain nevertheless on the average at least 2 such groups by reason of having 2 or more fluorinated occurrences. Also in the case of a fluorinated aliphatic group which is branched, each fluorinated branch may be considered a fluorinated aliphatic group for purpose of the description.

A surface treated with a hybrid polymer of the above general structure is autoadaptable in character in that it exhibits hydrophobic and oleophobic properties in air, but due to the hydrophilic segments and to their flexibility and mobility within the hybrid polymer, the surface exhibits hydrophilicity and oleophobicity in water. Characteristically, polymers which exhibit the properties herein described and have the structure herein described have a shear modulus at the working temperature in an aqueous environment of less than $10^{10}$, preferably less than $10^7$, dynes/cm.$^2$.

The preferred hybrid copolymers useful in the present invention comprise a balance of the following:

(i) one or more hydrophilic segments containing an average of more than two water-solvatable polar groups and substantially free from fluorinated aliphatic pendent groups of at least 3 carbon atoms terminated by trifluoromethyl groups, and in which the structural units containing the water-solvatable polar groups constitute at least 25% by weight of the hydrophilic segments, and (ii) one or more fluorinated segments substantially free from water-solvatable polar groups and containing an average of at least two fluoroaliphatic pendent groups, which contain at least 3 and not more than 20 fully fluorinated carbon atoms and provide in the copolymer at least 1% fluorine, the intraconnecting structure of said fluorinated segments being non-glassy and amorphous at a temperature not higher than 99° C., said copolymer having not more than 50% by weight of interconnecting structure linking the hydrophilic and fluorinated segments, and being internally oleophobic and substantially water insoluble when applied to a fabric and being reversibly autoadaptable on said fabric at a temperature between 50° C. and 130° C. to environmental conditions encountered during a laundering-drying cycle whereby it repeatedly displays an oleophobic surface in air and a hydrophilic surface and net oleophobicity in water.

Other preferred hybrid copolymers comprise a balance of the following:

(i) one or more hydrophilic linear segments containing an average of more than two water-solvatable polar groups and a hetero atom selected from at least one of the group consisting of oxygen, sulfur and nitrogen, and substantially free from fluorinated aliphatic pendent groups of at least 3 carbon atoms terminated by trifluoromethyl groups, and in which the structural units containing the water-solvatable polar groups constitute at least 25% by weight of the hydrophilic segments, and (ii) one or more fluorinated segments substantially free from water-solvatable polar groups and containing an average of at least two fluoroaliphatic pendent groups terminated by trifluoromethyl groups, which contain at least 3 and not more than 20 fully fluorinated carbon atoms and provide in the copolymer at least 1% bound fluorine, the intraconnecting structure of said fluorinated segments being substantially free of fluorine and the fluorinated segments being non-glassy and amorphous at a temperature not higher than 130° C., said copolymer having not more than 50% by weight of interconnecting structure linking the hydrophilic and fluorinated segments, and being internally oleophobic and substantially water insoluble when applied to a fabric and being reversibly autoadaptable on said fabric at a temperature between 50° C. and 130° C. to environmental conditions encountered during a laundering-drying cycle whereby it repeatedly displays an oleophobic surface in air and a hydrophilic surface with net oleophobicity in water.

The most preferred hybrid copolymer is a poly(oxyalkylene) copolymer of (a) $C_8F_{17}SO_2N(CH_3)C_2H_4OCOCH{=}CH_2$, (b) $CH_2{=}C(CH_3)COO(CH_2CH_2O)_{90}H$, and (c) $CH_2{=}C(CH_3)COO(CH_2CH_2O)_{90}COC(CH_3){=}CH_2$, preferably in a 50:50 weight ratio of a:(b+c) and a 3:1 weight ratio of b:c.

DETAILED DESCRIPTION

The hybrid copolymers are preferably fluoroaliphatic radical-containing poly(oxyalkylene) polymers (or oligomers). Generally, the oxyalkylene polymers will contain about 5 to 40 weight percent, preferably about 10 to 30 weight percent, of carbon-bonded fluorine. The oxyalkylene group can have 2 to 4 carbon atoms, such as $-OCH_2CH_2-$, $-OCH_2CH_2CH_2-$, $-OCH(CH_3)CH_2-$, and $-OCH(CH_3)CH(CH_3)-$.

The molecular weight of the poly(oxyalkylene) radical can be as low as 220 but preferably is about 500 to 2,500 and higher, e.g. 100,000 to 200,000 or higher.

The polyacrylates are a particularly useful class of poly(oxyalkylenes) and they can be prepared, for example, by free radical initiated copolymerization of a fluoroaliphatic radical-containing acrylate with a poly(oxyalkylene) acrylate, e.g. monoacrylate or diacrylate or mixtures thereof. As an example, a fluoroaliphatic acrylate, $R_f-R^6-O_2C-CH{=}CH_2$ (where $R^6$ is, for example, sulfonamidoalkylene, carbonamidoalkylene, or alkylene), e.g., $C_8F_{17}SO_2N(C_4H_9)CH_2CH_2O_2CCH{=}CH_2$, can be copolymerized with a poly(oxyalkylene) monoacrylate, $CH_2{=}CHC(O)(OC_2H_4)_n-OCH_3$, to produce a polyacrylate oxyalkylene.

Further description of fluorochemical oxyalkylenes useful in this invention will be omitted in the interest of brevity since such compounds and their preparation are known, said U.S. Pat. Nos. 3,787,351 and 3,574,791, both of which have been incorporated herein for that purpose.

A preferred hybrid copolymer according to these patents is made as follows: Polyethylene glycol of average molecular weight about 3000 is converted to the dimethacrylate by azeotropically removing water over 8 to 10 hours from a refluxing agitated reaction mixture under nitrogen of 54 kg. of the glycol, 31.5 kg. of toluene, 3.2 kg. of methacrylic acid, 16 g. of phenothiazine and 570 g. of sulphuric acid. The toluene is then removed and the residue dissolved in trichloroethylene. After neutralization with 2.3 kg. of calcium hydroxide and filtration using 2.3 kg. of filteracid, the filtrate is concentrated to residue at 10 mm. Hg pressure and 60° C., cast into a tray and allowed to solidify. The saponification equivalent is 1700 corresponding to an average molecular weight of about 3400, calculated as dimethacrylate.

A 50/50 copolymer is prepared in solution in 61 kg. of ethyl acetate from 12 kg. of N-methylperfluoroctanesulfonamidoethyl acrylate, 14.4 kg. of the above ester and 429 g. of n-octylmercaptan using 153 g. of azobisisobutyronitrile as initiator. Heating and agitation are maintained at 70° C. for 16 hours and the solution is then filtered through a 25 micron filter. There is about 90% conversion to polymer. The ethylacetate is evaporated under vacuum and the resultant hybrid copolymer is dispersed in water, typically at about 35% solids.

The primary requirements for the fabric sizing agent are that it be film-forming, water soluble or dispersible and thus readily removed from the fabic surface and that it can be combined with the hybrid copolymer. Included in the category of sizing agents suitable for utilization in this invention are the natural starches, most of which are polymeric compounds of glucose. The many modified starches are also suitable and include those produced through acid conversion oxidation, enzyme conversion, dextrinization and those pregelatinized varieties manufactured by rupturing the starch granules. In addition, other water soluble gums of vegetable and synthetic origin are suitable. Also useful are carbohydrates, glues, salts of complex organic acids such as gum Arabic as well as synthetic gums such as carboxymethyl cellulose, hydroxyethyl cellulose, methyl cellulose and a host of other cellulose esters and ethers, polyvinyl alcohol and other known sizing materials. Other factors which should be considered in selecting the proper sizing agent are the amount of stiffening desired, ease of formulation with water, final appearance of the garment from a luster and color standpoint and ease of application to the garment.

The present invention does not pertain to the chemistry of the specific compounds utilized, nor is novelty asserted as to the more general principle of fabric sizing. This invention deals with the specific novel idea of the herein described fabric treating composition, and with the discovery that new and improved results can thereby be obtained for garments requiring frequent laundering. The term laundering or washing refers to the normal process of immersing garments or fabrics in an ample quantity of water with suitable agitation so that deposited soil on the garment or fabric is removed and floated away. Usually a soap or detergent is used for assisting in soil removal although the presence of either is desirable but not necessary. The temperature of water is not critical although the normal range is about 20° C. to 70° C.

Since the fabric treating composition of the present invention is primarily intended for utilization on garments such as shirts and blouses where frequent laundering is required, a simple method for applying the composition to such garments after each laundering is required. Of course, the normal method for the application of an aqueous fabric sizing solution wherein the article to be treated is immersed in the sizing solution and then dried could be utilized. In many cases, however, the user would not want to size the entire garment. This is particularly true for shirts or blouses where only the areas of greatest soiling, i.e., the collar and sleeve cuffs, would be sized.

Thus, a method whereby the fabric treating composition could be selectively applied to such frequently laundered items would be preferred. One preferred such dispensing method involves the use of a manually operated spray pump, e.g., the type operated with plunger or trigger. Another such a method is realized with an aerosol or self-pressurized package which permits the composition to be dispensed in spray form. This not only allows for efficient dispensing of the fabric treating composition onto the desired areas of treatment, but, in addition, offers the convenience and the ability to dampen the garments for ironing simultaneously with the sizing operation.

The use of the self-pressurized package as the form of packaging, of course, necessitates and permits several modifications of the formulation to adapt it to a self-pressurized system. Common corrosion inhibitors such as sodium borate, monoethanol amine or ammonia would normally be added. Also, if desired, a brightening agent can be added to provide the necessary whiteness to convey the appearance of a cleaner garment. Typical brighteners which have been found useful are the organic fluorescent materials such as "Calcofluor" ST, "Calcofluor" CBP, "Tinopal" 2BA and "Emkatint" C.

In addition, items such as starch plasticizers can be incorporated to achieve a finer textured finish and provide better hand-appeal to the user. These plasticizers can include the sulfonated castor oils or the monocrystalline or paraffin waxes. Ironing aids such as silicones, glycols and waxes can also be used to impart good glide characteristics to the iron during ironing of the treated garment. Better freeze-thaw stability can be built into the formulation with the inclusion of various salts such as sodium chloride or sodium tetraborate. The utilization of a light perfume can add further aesthetic qualities to the composition. If natural sizes are used, a bacteriostat perservative such as formaldehyde and the short chain ester of parahydroxy benzoic acid can be included.

It will be apparent from the foregoing that the treating composition of the present invention must be an aqueous based system. However, the intrinsic oil and water resistant properties of the fluorocarbon compounds may present a problem of stabilizing the fluorocarbon compound in an aqueous system. The hybrid copolymer fluorocarbon compound could be stabilized in an aqueous system by the proper selection of processing aids and process conditions. In particular, certain organic solvents and/or surfactants will properly stabilize the hybrid copolymer in the sizing composition in order to obtain a stable mixture, as is well known in the art.

The ratios of hybrid copolymer to sizing agent will depend upon the specific ingredients used and it has been found that they can vary from about 1:1 to as high as about 1:50, preferably about 1:1 to about 1:10.

EXAMPLES

The following examples serve to illustrate the present invention without limitation thereof. Parts are by weight unless otherwise indicated.

EXAMPLE 1

| Parts | Ingredient |
|---|---|
| 93.31 | Deionized water |
| 3.00 | Hydroxyethyl cellulose sizing agent available under the trade designation "Natrosol" 180 JR |
| 0.10 | Ammonium hydroxide (28% ammonia) |
| 3.33 | Hybrid copolymer (30% solids), poly(oxyalkylene) copolymer of $C_8F_{17}SO_2N(CH_3)C_2H_4OCOCH{=}CH_2$, $CH_2{=}C(CH_3)COO(CH_2CH_2O)_{90}H$, and $CH_2{=}C(CH_3)COO(CH_2CH_2O)_{90}COC(CH_3){=}CH_2$ |
| 0.10 | Optical brightener, available under the trade designation "Sandoz" TH-40 |
| 0.0012 | Polyoxyethylene sorbitan monooleate surfactant stabilizer available under the trade designation "Tween" 80 |
| 0.0598 | Fragrance available under the trade designation "Freshol" #74 |
| 0.10 | Ethyl p-hydroxybenzoate preservative (Ethylparaben) |

A spray composition was formulated with 94 parts of the above as fill and 6 parts of an aerosol propellant.

EXAMPLE 2

Identical to Example 1, except the sizing agent, 3.00 parts "Natrosol" 180JR, was replaced with 3.00 parts "Elvanol" 71-30 (polyvinyl alcohol).

EXAMPLE 3

| Parts | Ingredient |
|---|---|
| 90.36 | Deionized water |
| 2.00 | Stabilizer for hybrid copolymer, diethylene glycol monobutyl ether available under the trade designation Butyl "Carbitol" |
| 0.75 | Polyethylene glycol anti-stick compound available under the trade designation "Carbowax" 1450 |
| 3.00 | Modified starch sizing agent, available under the trade designation "Flokote" 64 |
| 3.33 | Hybrid copolymer, 30% solids, described in Example 1 |
| 0.10 | Optical brightener "Sandoz" TH-40 |
| 0.0588 | Fragrance ("Freshol" #74) |
| 0.0012 | Surfactant ("Tween" 80) |
| 0.00075 | Blueing agent available under the trade designation "Sandolan Blue" E-HRL |
| 0.10 | Preservative (Ethylparaben) |
| 0.30 | Ammonium hydroxide (28% ammonia) |

EXAMPLE 4

Identical to Example 3 except the sizing agent, 3.0 parts "Flokote" 64, was replaced with 1.25 parts "Hercules" CMC-7LF (carboxymethyl cellulose), "Carbowax" 1450 was eliminated, and the water was 92.86 parts.

EXAMPLE 5

Same as Example 2 but the sizing agent, 3 parts "Elvanol" 71-30, was replaced with 3 parts modified starch available under the trade designation "Keocote" 44).

Control A

A commercial aerosol spray starch available under the trade designation "Niagara" spray starch.

Control B

Same as Example 5 but the hybrid copolymer (3.33 parts, 30% solid, defined in Example 1) was replaced with 4.78 parts of a 20.9% active fluorocompound which is a 2:1 diurethane adduct of $C_8F_{17}SO_2N(C_2H_5)C_2H_4OH$ and toluene diisocyanate according to U.S. Pat. No. 3,575,899 and the water was 91.85 parts.

Testing

The examples according to the present invention and the control examples described above were used on test fabric samples and evaluated for oil repellency, water repellency and soil release. The test fabrics are designated as "cotton" which is style 419B bleached, mercerized 136×60 combed 3.11 cotton broadcloth with a wash and wear finish and "Dacron/Cotton" which was style 7406 WRL "Dacron" 54W polyester/cotton 65/35 bleached fabric blend with a durable press finish. Both test samples were obtained from Test Fabrics of America Inc. of Middlesex, N.J. The test fabrics were preconditioned before testing by machine washing in hot water with 90 grams of "Tide" detergent and 1 cup of chlorine bleach and then in hot water with 60 grams of "Calgon" water conditioner.

The water repellency test is one which is often used for this purpose. The aqueous stain or water repellency of treated samples is measured using a water/isopropyl alcohol test, and is expressed in terms of a water repellency rating of the treated fabric. Treated fabrics which are penetrated by or resistant only to a 100 percent water/0 percent isopropyl alcohol mixture (the least penetrating of the test mixtures) are given a rating of 100/0, whereas treated fabrics resistant to a 0 percent water/100 percent isopropyl alcohol mixture (the most penetrating of the test mixtures) are given a rating of 0/100. Other intermediate values are determined by use of other water/isopropyl alcohol mixtures, in which the percentage amounts of water and isopropyl alcohol are each multiples of 10. Results are reported as an average of replicate testing. The water repellency rating corresponds to the most penetrating mixture which does not penetrate or wet the fabric after 30 seconds contact. In general a water repellency rating of 90/10 or better, e.g., 80/20, is desirable for fabric.

The oil repellency test is also one which is often used for this purpose. The oil repellency of treated carpet and textile samples is measured by AATCC Standard Test 118-1978, which test is based on the resistance of treated fabric to penetration by oils of varying surface tensions. Treated fabrics resistant only to "Nujol", a brand of mineral oil and the least penetrating of the test oils, are given a rating of 1, whereas treated fabrics resistant to heptane (the most penetrating of the test oils) are given a value of 8. Other intermediate values are determined by use of other pure oils or mixtures of oils. The rated oil repellency corresponds to the most penetrating oil (or mixture of oils) which does not penetrate or wet the fabric 30 seconds contact. Higher numbers indicate better oil repellency. In general, an oil repellency of 2 or greater is desirable for fabric.

The soil release test is an American National Standard Test Method (AATCC Test Method 130-1981) entitled the "Soil Release:Oily Stain Release Method". The test method involves placing 5 drops of mineral oil (available under the trade designation "Nujol" or other standard stain in the approximate center of a test specimen of fabric, placing a square of glassine paper over the oil stain or puddle, placing a 5 lb. (2.3 kg.) directly over the glassine paper covering the puddle, allowing the weight to sit undisturbed for 60 seconds, removing the weight and discarding the glassine sheet, and washing the test specimen within 15 to 60 minutes after staining. Washing was at a temperature of 41° C., adding 140 g detergent available under the trade designation "Tide" in the washer with the test specimen ballast to make the total load equal 1.8 kg, washing for 12 minutes in a standard washer, placing the entire load, test specimen and ballast, into a dryer and drying at a maximum stack temperature of 70° C. for 45 minutes. The washed specimen is then compared to a stain release replica and observed for degree of staining. A stain rating of "5" represents the best stain removal while a rating of "1" represents the poorest stain removal. Intermediate values are assigned between 1 and 5. Other substance can be used in place of the mineral oil using the stain release replica for evaluation. In the present case, dirty motor oil, spaghetti sauce and blueberry stain were utilized.

The results of testing are shown in Tables I-IV.

TABLE I (Dacron/Cotton)

| | STAIN RATING | | | | |
|---|---|---|---|---|---|
| TREATMENT | Dirty Motor Oil | Spaghetti Sauce | Blueberry | OIL REPELLENCY | WATER REPELLENCY |
| Example 1 | 3.4 | 4.7 | 4.3 | 7 | 0/100 |
| Example 2 | 3.5 | 4.4 | 4.3 | 7 | 0/100 |
| Example 5 | 3.1 | 4.2 | 4.1 | 6.5 | 0/100 |
| Control A | 1.4 | 1.4 | 3.3 | 0 | Failed |
| Control B | 1.1 | 2.5 | 4.2 | 6 | 45/55 |
| None | 1.1 | 1.2 | 3.5 | 0 | Failed |

TABLE II (Cotton)

| | STAIN RATING | | | | |
|---|---|---|---|---|---|
| TREATMENT | Dirty Motor Oil | Spaghetti Sauce | Blueberry | OIL REPELLENCY | WATER REPELLENCY |
| Example 1 | 4.2 | 4.7 | 3.8 | 5.5 | 0/100 |
| Example 2 | 3.6 | 4.7 | 3.2 | 5 | 0/100 |
| Example 5 | 3.6 | 4.3 | 3.4 | 5 | 0/100 |
| Control A | 1.5 | 1.8 | 3.0 | 0 | Failed |
| Control B | 2.7 | 3.6 | 3.6 | 5 | 85/10 |
| None | 1.1 | 2.2 | 3.4 | 0 | Failed |

TABLE III (Cotton)

| TREATMENT | STAIN RATING SPAGHETTI SAUCE | OIL REPELLENCY | WATER REPELLENCY |
|---|---|---|---|
| Example 3 | 3.9 | 5.5 | 10/90 |
| Example 4 | 3.3 | 6 | 5/95 |
| Control A | 1.4 | 0 | Failed |

TABLE IV (Dacron/Cotton)

| TREATMENT | STAIN RATING SPAGHETTI SAUCE | OIL REPELLENCY | WATER REPELLENCY |
|---|---|---|---|
| Example 3 | 4.5 | 6.5 | 0/100 |
| Example 4 | 4.2 | 6.5 | 0/100 |
| Control A | 1.4 | 0 | Failed |

I claim:

1. A fabric treating composition for frequently laundered fabrics capable of rendering the surface of fabric treated therewith oleophobic and hydrophobic under atmospheric conditions, said composition comprising (a) water-soluble fabric sizing agent;

(b) reversibly autoadaptable segmented hybrid copolymer having a maximum glass temperature below about 130° C. comprising a balance of the following:

(i) one or more hydrophilic segments containing an average of more than two water-solvatable polar groups and substantially free from fluorinated aliphatic pendent groups of at least 3 carbon atoms terminated by trifluoromethyl groups, and (ii) one or more fluorinated segments substantially free from water-solvatable polar groups and containing an average of at least two fluoroaliphatic pendent groups terminated by trifluoromethyl groups, which contain at least 3 and not more than 20 fully fluorinated carbon atoms and provide in the copolymer at least 1% bound fluorine, the intraconnecting structure of said fluorinated segments being substantially free of fluorine and the fluorinated segments being non-glassy and amorphous at a temperature not higher than 130° C., said copolymer being internally oleophobic and substantially water insoluble after application to said fabric; and (c) water wherein the weight ratio of hybrid copolymer to sizing agent is greater than about 1 part hybrid copolymer to 50 parts sizing agent and the concentration of sizing agent in said composition is at least about 0.05% by weight.

2. The fabric treating composition of claim 1 wherein said reversibly autoadaptable segmented hybrid copolymer comprises:

(i) one or more hydrophilic segments containing an average of more than two water-solvatable polar groups and substantially free from fluorinated aliphatic pendent groups of at least 3 carbon atoms terminated by trifluoromethyl groups, and in which the structural units containing the water-solvatable polar groups constitute at least 5% by weight of the hydrophilic segments, and (ii) one or more fluorinated segments substantially free from water-solvatable polar groups and containing an average of at least two fluoroaliphatic pendent groups, terminated by trifluoromethyl groups, which contain at least 3 and not more than 20 fully fluorinated carbon atoms and provide in the copolymer at least 1% fluorine, the intraconnecting structure of said fluorinated segments being substantially free of fluorine and the fluorinated segments being non-glassy and amorphous at a temperature not higher than 99° C., said copolymer having not more than 50% by weight of interconnecting structure linking the hydrophilic and fluorinated segments, and being internally oleophobic and substantially water insoluble when applied to a fabric and being reversibly autoadaptable on said fabric at a temperature between 50° and 130° C. to environmental conditions encountered during a laundering-drying cycle whereby it repeatedly displays an oleophobic surface in air and a hydrophilic surface and net oleophobicity in water.

3. The fabric treating composition of claim 1 wherein said reversibly autoadaptable segmented hybrid copolymer comprises:

(i) one or more hydrophilic linear segments containing an average of more than two water-solvatable polar groups and a hetero atom selected from at least one of the group consisting of oxygen, sulfur and nitrogen, and substantially free from fluorinated aliphatic pendent groups of at least 3 carbon atoms terminated by trifluoromethyl groups, and in which the structural units containing the water-solvatable polar groups constitute at least 25% by weight of the hydrophilic segments, and (ii) one or more fluorinated segments substantially free from water-solvatable polar groups and containing an average of at least two fluoroaliphatic pendent groups terminated by trifluoromethyl groups, which contain at least 3 and not more than 20 fully fluorinated carbon atoms and provide in the copolymer at least 1% bound fluorine, the intraconnecting structure of said fluorinated segments being substantially free of fluorine and the fluorinated segments being non-glassy and amorphous at a temperature not higher than 130° C., said copolymer having not more than 50% by weight of interconnecting structure linking the hydrophilic and fluorinated segments, and being internally oleophobic and substantially water insoluble when applied to a fabric and being reversibly autoadaptable on said fabric at a temperature between 50° and 130° C. to environmental conditions encountered during a laundering-drying cycle whereby it repeatedly displays an oleophobic surface in air and a hydrophilic surface with net oleophobicity in water.

4. The fabric treating composition of claim 1 wherein said sizing agent is selected from the group consisting of natural starches, modified starches, water soluble gums, carbohydrates, glues, salts of complex organic acids, polyvinyl alcohol, cellulose esters, cellulose ethers and mixtures thereof.

5. The fabric treating composition of claim 1, 2, or 3 wherein the ratio of hybrid copolymer to sizing agent is in the range of 1:1 to 1:10.

6. The composition of claim 1, 2, or 3 wherein the concentration of said sizing agent in said composition is in the range of about 1% to 5% by weight.

7. The composition of claim 1, 2 or 3 wherein said fabric sizing agent is modified starch.

8. The composition of claim 1 wherein said hybrid copolymer is a poly(oxyalkylene) copolymer of $C_8F_{17}SO_2N(CH_3)C_2H_4OCOCH{=}CH_2$, $CH_2{=}C(CH_3)COO(CH_2CH_2O)_{90}H$, and $CH_2{=}C(CH_3)COO(CH_2CH_2O)_{90}COC(CH_3){=}CH_2$.

9. Method of treating fabric comprising applying the composition of claim 1, 2 or 3 to said fabric and drying to substantially remove water.

10. Fabric treated with a composition comprising
(a) water-soluble fabric sizing agent; and
(b) reversibly autoadaptable segmented hybrid copolymer having a maximum glass temperature below about 130° C. comprising a balance of the following:
(i) one or more hydrophilic segments containing an average of more than two water-solvatable polar groups and substantially free from fluorinated aliphatic pendent groups of at least 3 carbon atoms terminated by trifluoromethyl groups, and
(ii) one or more fluorinated segments substantially free from water-solvatable polar groups and containing an average of at least two fluoroaliphatic pendent groups terminated by trifluoromethyl groups, which contain at least 3 and not more than 20 fully fluorinated carbon atoms and provide in the polymer at least 1% bound fluorine, the intraconnecting structure of said fluorinated segments being substantially free of fluorine and the fluorinated segments being non-glassy and amorphous at a temperature not higher than 130° C.,
wherein the weight ratio of hybrid copolymer to sizing agent is greater than 1 part hybrid copolymer per 50 parts fabric sizing agent.

11. Treated fabric according to claim 10 wherein said reversibly autoadaptable segmented hydrid copolymer comprises:
(i) one or more hydrophilic segments containing an average of more than two water-solvatable polar groupsand substantially free from fluorinated aliphatic pendent groups of at least 3 carbon atoms terminated by trifluoromethyl groups, and in which the structural units containing the water-solvatable polar groups constitute at least 25% by weight of the hydrophilic segments, and
(ii) one or more fluorinated segments substantially free from water-solvatable polar groups and containing an average of at least two fluoroaliphatic pendent groups, terminated by trifluoromethyl groups, which contain at least 3 and not more than 20 fully fluorinated carbon atoms and provide in the copolymer at least 1% fluorine, the intraconnecting structure of said fluorinated segments being substantially free of fluorine and the fluorinated segments being non-glassy and amorphous at a temperature not higher than 99° C.,
said copolymer having not more than 50% by weight of interconnecting structure linking the hydrophilic and fluorinated segments, and being internally oleophobic and substantially water insoluble when applied to a fabric and being reversibly autoadaptable on said fabric at a temperature between 50° and 130° C. to environmental conditions encountered during a laundering-drying cycle whereby it repeatedly displays an oleophobic surface in air and a hydrophilic surface and net oleophobicity in water.

12. Treated fabric according to claim 10 wherein said reversibly autoadaptable segmented hybrid copolymer comprises:
(i) one or more hydrophilic linear segments containing an average of more than two water-solvatable polar groups and a hetero atom selected from at least one of the group consisting of oxygen, sulfur and nitrogen, and substantially free from fluorinated aliphatic pendent groups of at least 3 carbon atoms terminated by trifluoromethyl groups, and in which the structural units containing the water-solvatable polar groups constitute at least 25% by weight of the hydrophilic segments, and
(ii) one or more fluorinated segments substantially free from water-solvatable polar groups and containing an average of at least two fluoroaliphatic pendent groups terminated by trifluoromethyl groups, which contain at least 3 and not more than 20 fully fluorinated carbon atoms and provide in the copolymer at least 1% bound fluorine, the intraconnecting structure of said fluorinated segments being substantially free of fluorine and the fluorinated segments being non-glassy and amorphous at a temperature not higher than 130° C.,
said copolymer having not more than 50% by weight of interconnecting structure linking the hydrophilic and fluorinated segments, and being internally oleophobic and substantially water insoluble when applied to a fabric and being reversibly autoadaptable on said fabric at a temperature between 50° and 130° C. to environmental conditions encountered during a laundering-drying cycle whereby it repeatedly displays an oleophobic surface in air and a hydrophilic surface with net oleophobicity in water.

13. The fabric of claim 10 wherein said hybrid copolymer is poly(oxyalkylene) copolymer of $C_8F_{17}SO_2N(CH_3)C_2H_4OCOCH{=}CH_2$, $CH_2{=}C(CH_3)COO(CH_2CH_2O)_{90}H$, and $CH_2{=}C(CH_3)COO(CH_2CH_2O)_{90}COC(CH_3){=}CH_2$.

* * * * *

UNITED STATES PATENT AND TRADEMARK OFFICE

CERTIFICATE OF CORRECTION

PATENT NO. : 4,624,889

DATED : November 25, 1986

INVENTOR(S) : James L. Bries

It is certified that error appears in the above-identified patent and that said Letters Patent is hereby corrected as shown below:

In the Claims;

Claim 2, Col. 11, line 61, "at least 5%" should read

--at least 25%--.

Signed and Sealed this

Twenty-eighth Day of April, 1987

*Attest:*

DONALD J. QUIGG

*Attesting Officer*

*Commissioner of Patents and Trademarks*